US012655698B2

(12) United States Patent
Bernard et al.

(10) Patent No.: US 12,655,698 B2
(45) Date of Patent: Jun. 16, 2026

(54) DETERMINING AND ADJUSTING DRILLING FLUID PROFILE

(71) Applicant: Aerion Rental Services LLC, Broussard, LA (US)

(72) Inventors: Benjamin Bernard, Lafayette, LA (US); Matthew Bernard, Lafayette, LA (US); Jeffrey Bernard, Houston, TX (US)

(73) Assignee: Aerion Rental Services LLC, Broussard, LA (US)

( * ) Notice: Subject to any disclaimer, the term of this patent is extended or adjusted under 35 U.S.C. 154(b) by 152 days.

(21) Appl. No.: 18/235,694

(22) Filed: Aug. 18, 2023

(65) Prior Publication Data

US 2024/0060370 A1 Feb. 22, 2024

Related U.S. Application Data

(60) Provisional application No. 63/399,250, filed on Aug. 19, 2022.

(51) Int. Cl.
*E21B 21/06* (2006.01)
*E21B 21/08* (2006.01)

(52) U.S. Cl.
CPC ..... *E21B 21/06* (2013.01); *E21B 21/08* (2013.01)

(58) Field of Classification Search
CPC ..... E21B 21/06; E21B 21/01
See application file for complete search history.

(56) References Cited

U.S. PATENT DOCUMENTS

| | | | | |
|---|---|---|---|---|
| 2008/0083566 | A1* | 4/2008 | Burnett | F26B 7/00 175/207 |
| 2020/0332626 | A1* | 10/2020 | Larchar | E21B 21/062 |
| 2021/0063294 | A1* | 3/2021 | Ye | E21B 21/062 |
| 2023/0287789 | A1* | 9/2023 | Mahavadi | E21B 49/088 |
| 2023/0323773 | A1* | 10/2023 | Whyte | E21B 21/06 73/152.24 |

* cited by examiner

*Primary Examiner* — Giovanna Wright
(74) *Attorney, Agent, or Firm* — Conley Rose, P.C.

(57) ABSTRACT

A system includes a container unit and a processor. The container unit includes a first fluid pathway having an inlet configured to couple to a first component of a drilling fluid circulation system, and having an outlet configured to couple to a second component of the drilling fluid circulation system. The container unit also includes a second fluid pathway having an inlet configured to couple to a third component of the drilling fluid circulation system, and having an outlet configured to couple to the third component. The container unit includes a first sensor coupled to the first fluid pathway and a second sensor coupled to the second fluid pathway. The processor is configured to determine a drilling fluid profile based on data from the sensors, and compare the determined drilling fluid profile to a target drilling fluid profile to determine an adjustment for an actual drilling fluid profile.

20 Claims, 5 Drawing Sheets

DETERMINING AND ADJUSTING DRILLING FLUID PROFILE

CROSS-REFERENCE TO RELATED APPLICATIONS

This application claims the priority to and benefits of U.S. Provisional Patent Application No. 63/399,250 filed on Aug. 19, 2022. The aforementioned patent application is hereby incorporated by reference in its entirety.

BACKGROUND

During the drilling of a well (e.g., a hydrocarbon well), a drilling fluid or "mud" is continuously circulated from the surface down to the bottom of the wellbore being drilled, and back to the surface again. Drilling fluid may be used to transport wellbore cuttings up to the surface, where they are separated from the drilling fluid. Drilling fluid also may be used to cool the drill bit and provide hydrostatic pressure on the walls of the drilled borehole to prevent wellbore collapse and the resulting influx of gas or liquid from the formations being drilled.

SUMMARY

In one example of the description, a system includes a container unit and a processor coupled thereto. The container unit includes a first fluid pathway having a first inlet configured to couple to a first component of a drilling fluid circulation system, and having a first outlet configured to couple to a second component of the drilling fluid circulation system. The container unit also includes a second fluid pathway having a second inlet configured to couple to a third component of the drilling fluid circulation system, and having a second outlet configured to couple to the third component. The container unit includes a first sensor coupled to the first fluid pathway and a second sensor coupled to the second fluid pathway. The processor is configured to receive first data indicative of a first drilling fluid parameter from the first sensor, receive second data indicative of a second drilling fluid parameter from the second sensor, determine a drilling fluid profile based on the first data and the second data, and compare the determined drilling fluid profile to a target drilling fluid profile to determine an adjustment for an actual drilling fluid profile.

In another example of the description, a method includes receiving data indicative of a drilling fluid parameter from a sensor coupled to a drilling fluid circulation system; determining a drilling fluid profile based on the data indicative of the drilling fluid parameter; comparing the determined drilling fluid profile to a target drilling fluid profile; and adjusting, based on the comparison, an actual drilling fluid profile.

In yet another example of the description, a system includes a sensor package configured to couple to fluid pathway of a drilling fluid circulation system. The sensor package includes an inlet configured to couple to the drilling fluid circulation system; an outlet configured to couple to the drilling fluid circulation system, where a fluid pathway is formed between the inlet and the outlet; a first sensor coupled to the fluid pathway; and a second sensor coupled to the fluid pathway. The system also includes a processor coupled to the first and second sensors. The processor is configured to receive first data indicative of a first drilling fluid parameter from the first sensor; receive second data indicative of a second drilling fluid parameter from the second sensor; determine a drilling fluid profile based on the first data and the second data; and compare the determined drilling fluid profile to a target drilling fluid profile to determine an adjustment for an actual drilling fluid profile.

DETAILED DESCRIPTION

Figure 1:
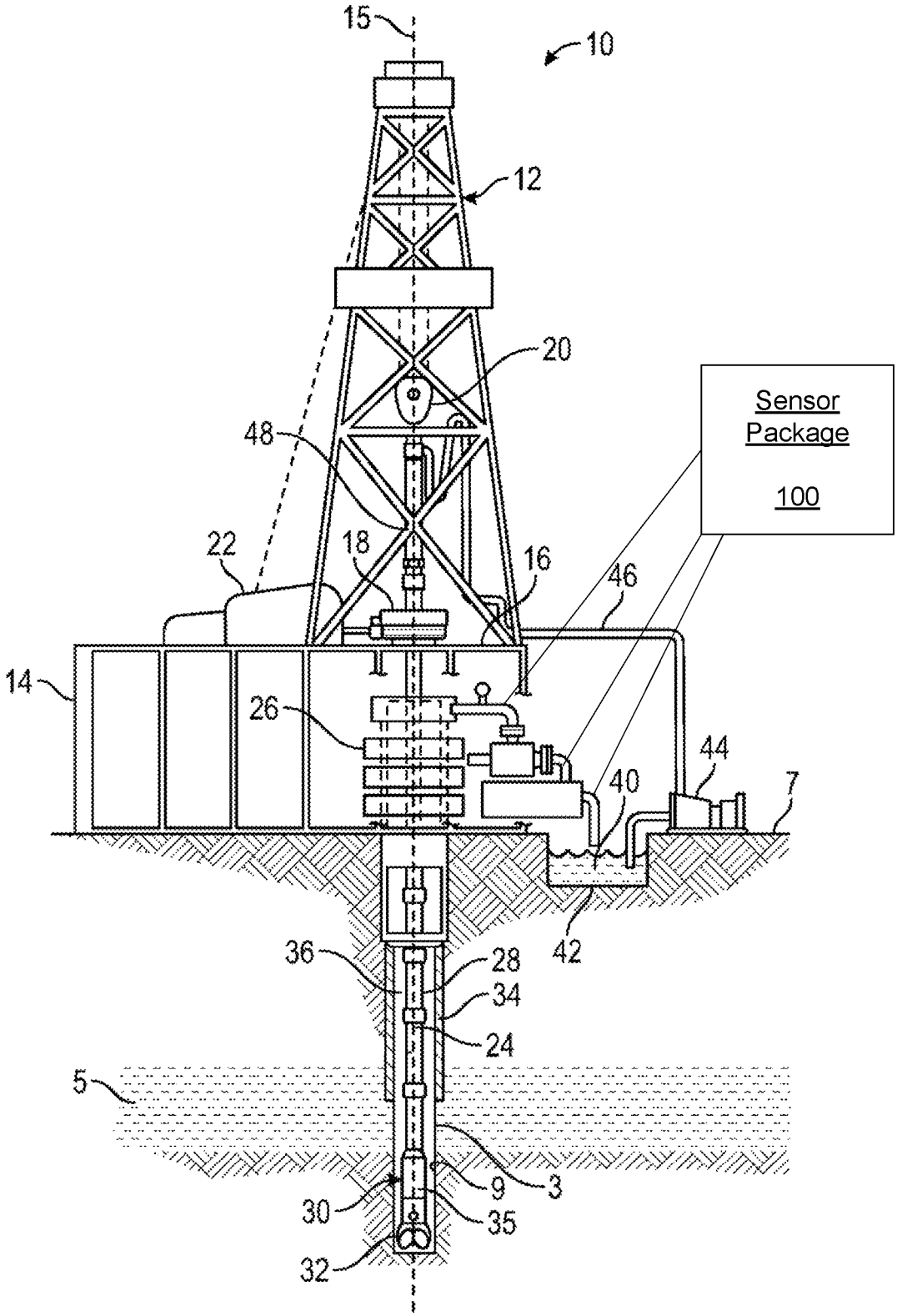
FIG. 1 is a schematic view of a drilling system including a drilling fluid circulation system in accordance with various examples.

The following discussion is directed to various embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection as accomplished via other devices, components, and connections. In addition, as used herein, the terms "axial" and "axially" generally mean along or parallel to a central axis (for example, central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the wellbore and with "down", "lower", "downwardly", "downhole", or "downstream" meaning toward the terminal end of the wellbore, regardless of the wellbore orientation.

In various scenarios, it may be useful to analyze drilling fluid as it is recirculated back to the surface. For example, drilling fluid may be analyzed to provide preliminary information about a potential hydrocarbon-bearing reservoir zone, and to determine properties of the drilling fluid that should be maintained within certain ranges for a given set of drilling parameters. The borehole wall may have different levels of structural integrity, and formation fluids may have different levels of internal pressure.

As described above, drilling fluid serves to stabilize the borehole wall and to counterbalance the internal pressure of the formation fluids. Accordingly, drilling mud density (e.g., mud weight) and composition may be adjusted to counteract these conditions, and to prevent damage to the borehole wall, loss of well control, and the like.

Drilling fluid circulation systems (also referred to as mud circulation systems) often do not include sensors to monitor drilling fluid parameters or conditions. Conventionally then, drilling fluid is analyzed in an off-line fashion, in which one or more samples of drilling fluid are collected (e.g., by a rig worker, by hand). The hand-collected samples are then tested at a remote location (e.g., remote from the mud circulation system) to determine properties of the drilling fluid. Accordingly, a lag time exists between the collection and testing of the samples. Also, such hand-collected samples may only be collected and tested on the order of once or twice per day, even under ideal conditions. This relatively long testing interval does not allow for accurate, ongoing measurements of drilling fluid properties or conditions, which may fluctuate (and thus benefit from being measured) more frequently than the relatively long hand-testing interval.

Also, retrofitting equipment of the mud circulation system to include sensors and/or the ability to measure drilling fluid parameters and/or conditions is costly and thus not particularly attractive to manufacturers of such equipment. Thus, there is little to no motivation to modify mud circulation systems (or the equipment components thereof) to include the ability to measure drilling fluid parameters and/or conditions.

Examples of the present disclosure address the foregoing by providing a standalone sensor package that is configured to be easily coupled to one or more fluid pathways of the mud circulation system. For example, the sensor package is constructed in a way such that it is easily retrofittable (e.g., plumbed into) the mud circulation system. The sensor package may be itself a standalone unit, or may be part of a container unit, which is easily transportable to various rig sites. In some examples, the container unit includes multiple such sensor packages, to enable sensing drilling fluid parameters along multiple fluid pathways. The container unit may include various inlets (e.g., to receive fluid from the mud circulation system) and outlets (e.g., to provide fluid back to the mud circulation system), and thus is configured to be plumbed into the mud circulation system.

The container unit includes at least one internal fluid pathway having an inlet and an outlet, which may be accessible from an exterior surface of the container unit. A single sensor package may also include one such inlet and a corresponding outlet. In both the sensor package and the container unit described herein, the inlet is configured to couple to the mud circulation system (e.g., a first component thereof), and the outlet is also configured to couple to the mud circulation system. In one example, the outlet also couples to the first component of the mud circulation system, and thus the fluid pathway in the container unit (or sensor package) functions as a recirculation pathway. In another example, the outlet couples to a second component of the mud circulation system, and thus the fluid pathway in the container unit (or sensor package) functions as a through pathway.

Irrespective of the particular inlet/outlet coupling, the container unit and/or sensor package also includes at least one sensor coupled to the fluid pathway. In examples in which the container unit includes multiple internal fluid pathways, one or more sensors may be coupled to each of the internal fluid pathways. Also, the container unit and/or sensor package may include supplemental or auxiliary pumps to induce or assist the flow of fluid from the mud circulation system through the fluid pathway(s) of the container unit. However, external pumps may also be used to induce or assist such fluid flow through the fluid pathway(s) of the container unit and/or sensor package. In the particular example where the fluid pathway is a recirculation pathway, the container unit (or sensor package) includes a pump coupled to the recirculation pathway to induce fluid flow through the recirculation pathway.

Accordingly, the sensor package described herein may be relatively easily coupled to an existing mud circulation system, such as by plumbing the container unit or standalone sensor package described herein to the mud circulation system. Subsequently, such as after the container unit (or sensor package) has been installed with, or integrated to the mud circulation system, the sensor package is configured to sense various drilling fluid parameters, conditions, and the like.

A computing device including a general purpose processor (e.g., a central processing unit (CPU), an application-specific integrated circuit (ASIC), or other combinations of programmable hardware and/or software) is configured to be coupled to the sensor(s) in the sensor package. For example, the container unit or sensor package may be configured to be coupled to a network (e.g., a wired network or a wireless network), to which the computing device is also configured to connect. Accordingly, the sensor(s) of the container unit or sensor package may provide data indicative of sensed parameters to the network, and the computing device is configured to receive such data from the sensors.

In various examples, the sensors may include, but are not limited to an oil-in-water electrode, an inline submerged chloride electrode, a fluid-solid content ultrasonic sensor, a Coriolis meter, a viscometer, and the like. Accordingly, the computing device may receive data indicative of the ratio of oil and water in drilling fluid from the oil-in-water electrode, a sodium chloride value from the above chloride electrode, a solids content of the drilling fluid, a viscosity of the drilling fluid, and the like. Any of these values may be further processed by one or more algorithms implemented by the computing device coupled to the container unit.

Based on the data received from the sensor(s), the computing device (and/or the processor thereof) is configured to determine a drilling fluid profile. As described above, drilling fluid may stabilize the borehole wall and counterbalance the internal pressure of formation fluids. Accordingly, the drilling fluid profile may include mud weight and composition information, which are parameters that may be adjusted from time to time during drilling operations to counteract these conditions, and to prevent damage to the borehole wall, loss of well control, and the like. For example, the computing device (and/or the processor thereof) is also configured to compare the determined drilling fluid profile to a target drilling fluid profile. The target drilling fluid profile may represent a combination of mud properties and/or mud composition information that is appropriate for drilling a particular section of the well, for example. The computing device (and/or the processor thereof) is also configured to determine an adjustment to the drilling fluid profile based on differences between the determined (or measured) drilling fluid profile and the target drilling fluid profile. For example, the adjustment may be to increase or decrease a mud weight of the drilling fluid. In this example, a drilling fluid control system may adjust the drilling fluid by sending signals (e.g., based on the determined adjustment) to solids control equipment, such as to digitally manipulate control parameters thereof. For example, detecting a high low-gravity solids content in the drilling fluid may result in operating a centrifuge at a higher bowl speed (e.g., revolutions per minute (RPM)), pump speed, and bowl conveyance, which enables dynamic manipulation of the mud system.

In some examples, the computing device (and/or the processor thereof) is configured to generate one or more control signals to automatically adjust the drilling fluid profile based on the comparison between the determined (or measured) drilling fluid profile and the target drilling fluid profile. These and other examples are described more fully below, with reference made to the accompanying figures.

Referring to FIG. 1, an embodiment of a well or drilling system 10 for drilling or producing hydrocarbons from a well or wellbore is shown. In this exemplary embodiment, drilling system 10 generally includes a vertical support structure or derrick 12 supported by a drilling platform 14. Platform 14 includes a drill deck or rig floor 16 supporting a rotary table 18 selectively rotated by a prime mover (not shown), such as an electric motor, controlled by a motor controller. Derrick 12 includes a traveling block 20 controlled by a drawworks 22 for raising and lowering a drillstring 24 suspended from traveling block 20. Drillstring 24 of drilling system 10 extends downward through the rotary table 18, a blowout preventer (BOP) stack 26, and into a wellbore 3 that extends into a subterranean earthen formation 5 along a central or longitudinal axis 15 from the surface 7. Drillstring 24 is formed from a plurality of drill pipe joints 28 connected end-to-end. In this exemplary embodiment, a bottom-hole-assembly (BHA) 30 is attached to the lowermost pipe joint 28 and a drill bit 32 is attached to the downhole end of BHA 30. In other embodiments, drilling system 10 may comprise an offshore drilling system that includes a drillstring that extends through a marine riser and into a subsea wellbore.

In this embodiment, drill bit 32 is rotated with rotary table 18 via drillstring 24 and BHA 30. By rotating drill bit 32 with weight-on-bit (WOB) applied thereto, the drill bit 32 disintegrates the subsurface formations to drill wellbore 3. In some embodiments, a top-drive may be used to rotate the drillstring 24 rather than rotation by the rotary table 18. In some applications, a downhole motor (mud motor) 35 is disposed in the drillstring 24 to rotate the drill bit 32 in lieu of or in addition to rotating the drillstring 24 from the surface 7. Particularly, the mud motor 35 may rotate the drill bit 32 when a drilling fluid passes through the mud motor 35 under pressure. In this exemplary embodiment, a casing string 34 is installed and extends downward generally from the surface 7 into at least a portion of wellbore 3. In some embodiments, casing string 34 is cemented within the wellbore 3 to isolate various vertically-separated earthen zones and prevent fluid transfer between the zones. BOP stack 26 is secured to the uphole end of casing string 34. Casing string 34 may comprise multiple tubular members, such as pieces of threaded pipe that are joined end-to end to form liquid-tight or gas-tight connections, to prevent fluid and pressure exchange between wellbore 3 and the surrounding earthen zone.

An annular space or annulus 36 is formed between both the sidewall 9 of wellbore 3 and drillstring 24 and between inner surface of casing string 34 and drillstring 24. In other words, annulus 36 extends through wellbore 3 and casing string 34. BOP stack 26 includes an annular space or flow path in fluid communication with annulus 36. An operator or drilling control system of drilling system 10 may selectively and controllably open and close one or more BOPs of BOP stack 26 to allow, to restrict, or to inhibit the flow of drilling fluid or another fluid through annulus 36.

In this exemplary embodiment, drilling system 10 includes a mud circulation system to circulate drilling fluid or mud 40 down drillstring 24 and back up annulus 36. Drilling fluid 40 generally functions to cool drill bit 32, remove cuttings from the bottom of wellbore 3, and maintain a desired pressure or pressure profile in wellbore 3 during drilling operations. The mud circulation system is described in finer detail, below. The mud circulation system may include at least a drilling fluid reservoir or mud tank 42, a supply pump 44, a supply line 46 connected to the outlet of supply pump 44, and a kelly 48 for supplying drilling fluid 40 to the drillstring 24.

In this exemplary embodiment, along with the mud circulation system, the drilling system 10 includes a sensor package 100 that is configured to be coupled to the mud circulation system. As described above, a computing device may be coupled to the sensor package 100, and thus configured to receive sensor data therefrom. However, the computing device is not depicted in FIG. 1 for simplicity. Although FIG. 1 includes a single sensor package 100, in other examples, multiple sensor packages may be coupled to the mud circulation system. Irrespective of the particular configuration, or number of sensor(s) and/or sensor package (s), the computing device is configured to receive sensor data indicative of one or more drilling fluid parameters and/or conditions from the sensor package 100.

The sensor package 100 may be constructed in a way such that it is easily retrofittable to (e.g., plumbed into) the mud circulation system. The sensor package 100 may be a standalone sensor package 100 that includes multiple individual sensors, and may also include a computing device coupled thereto that is configured to receive sensor data from the sensor(s) of the sensor package 100. The sensor package 100 may also be part of a container unit (which itself may include multiple such sensor packages 100), which is easily transportable to various rig sites. The container unit may include various inlets (e.g., to receive fluid from the mud circulation system) and outlets (e.g., to provide fluid back to the mud circulation system), and thus is configured to be plumbed into the mud circulation system.

Figure 2:
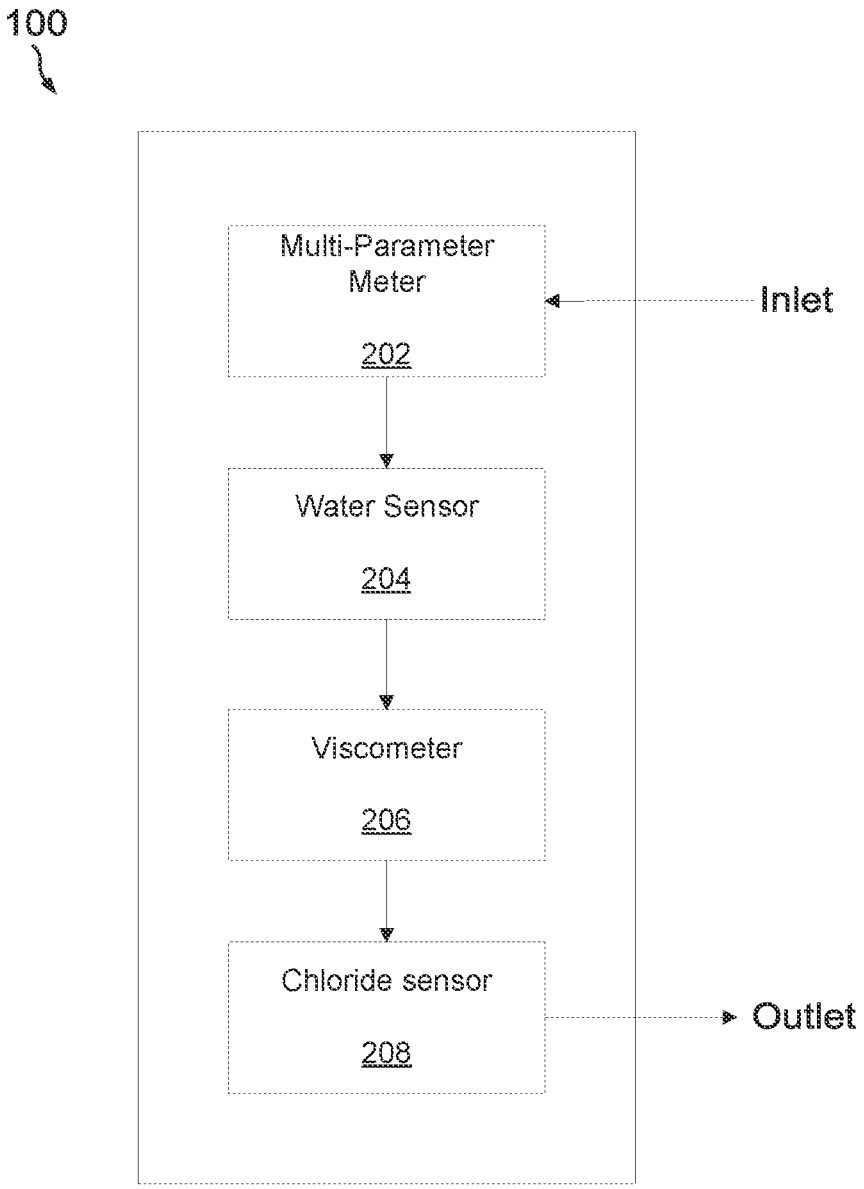
FIG. 2 is a schematic block diagram of the sensor package of FIG. 1 in accordance with various examples.

FIG. 2 is a schematic block diagram of the sensor package 100 of FIG. 1 in further detail. In the example of FIG. 2, the sensor package 100 is a standalone sensor package 100, which may be directly plumbed into an existing fluid pathway of the mud circulation system of drilling system 10. The standalone sensor package 100 is generally modular, and thus may be more easily positioned among the drilling system 100, and also reduce the amount of plumbing needed to couple the sensor package 100 to a fluid pathway of the mud circulation system.

In the example of FIG. 2, the sensor package 100 includes a multi-parameter meter 202, a water meter 204, a viscometer 206, and a chloride sensor 208. In other examples, the sensor package 100 may include more or fewer sensors/meters, which may also be arranged in different orders than that shown in FIG. 2. In FIG. 2, a fluid inlet of the sensor package 100 is coupled to the multi-parameter meter 202, while a fluid outlet of the sensor package 100 is coupled to the chloride sensor 208. Regardless of the sensors to which the inlet and outlet are coupled, a fluid pathway is formed between the inlet and the outlet by the various sensors coupled thereto.

The multi-parameter meter 202 may be configured to generate data indicative of a solids content, a density, a specific gravity, and a temperature of the fluid flowing therethrough. In other examples, the multi-parameter meter 202 may generate data indicative of more parameters, fewer parameters, and/or different parameters. The water sensor 204 is configured to generate data indicative of a water content of the fluid flowing therethrough. Accordingly, an oil percentage of the drilling fluid may be determined based on the data indicative of the solids content from the multi-parameter meter 202 and the data indicative of the water content from the water sensor 204. The viscometer 206 is configured to generate data indicative of a viscosity of the fluid flowing therethrough, and the chloride sensor 208 is configured to generate data indicative of a chloride content of the fluid flowing therethrough.

The data generated by the various sensors/meters 202, 204, 206, 208 is provided to a computing device, which may be coupled to/integrated with the sensor package 100 in some examples. In other examples, the computing device is located remotely from the sensor package 100, and the sensor data is provided to the computing device over a wired connection, a wireless connection, or a combination thereof. The function of the computing device is described in further detail below with reference to FIG. 4.

Figure 3:
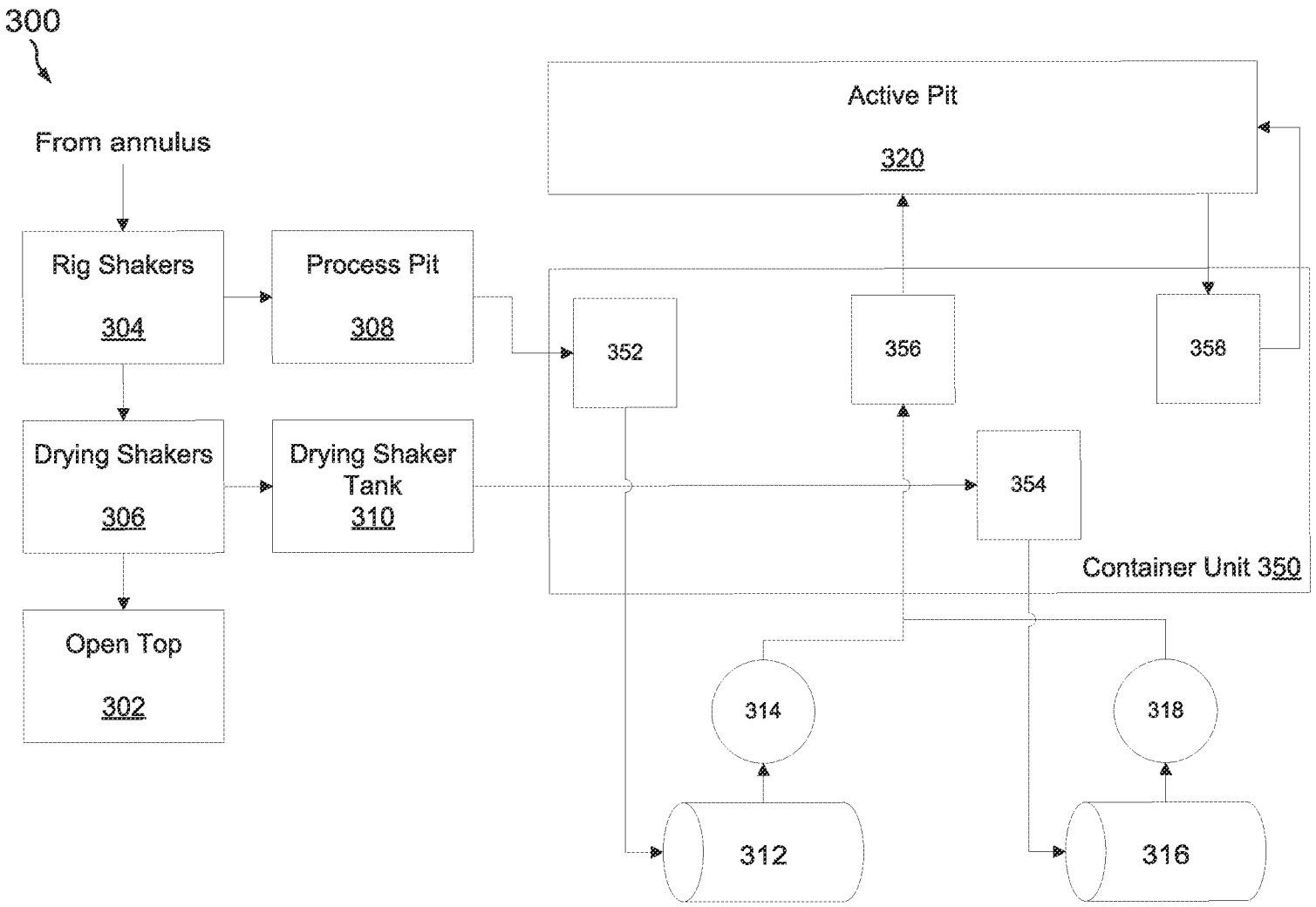
FIG. 3 is a schematic block diagram of the drilling fluid circulation system of FIG. 1, and including a container unit in accordance with various examples.

FIG. 3 is a schematic block diagram of a drilling fluid circulation system 300 (also referred to as a mud circulation system 300) that can be implemented in the drilling system 10 of FIG. 1 in some examples. In the example of FIG. 3, a container unit 350 is configured to be coupled to (e.g., plumbed into) the mud circulation system 300 in accordance with various examples. Various pumps (and/or other devices configured to induce drilling fluid to flow through the mud circulation system 300) are omitted from FIG. 3 for simplicity. However, it should be understood that such pumps may be present in the system 300, in various locations, and, in at least some examples, the container unit 350 may include one or more internal pumps as well. Unless specifically noted otherwise, the scope of this disclosure is not limited to a particular number and/or configuration of pumps or other fluid-moving devices.

The mud circulation system 300 includes an open top tank 302, or an open top 302 that is configured to receive solids from drilling fluid that is pumped back from the drill bit 32 through the annulus 36, as described above.

The mud circulation system 300 also includes a rig shaker 304, which is configured to receive drilling fluid from the annulus 36, as described above. The rig shaker 304 is configured to separate coarser well cuttings from the drilling fluid. Drilling fluid from the rig shaker 304 is provided to a process pit 308. A drying shaker 306 may be optionally coupled to and configured to receive solids from the rig shaker 304 (e.g., after the rig shaker 304 has separated coarser solids from the drilling fluid). The rig shaker 306 is configured to perform further fluid-solids separation, which may improve efficiency in some examples. Unless specifically noted otherwise, the scope of this disclosure is not limited to a particular shaker configuration. For example, multiple rig shakers 304 may be arranged in parallel, with a drying shaker 306 coupled to each rig shaker 304.

As described, the process pit 308 is coupled to and configured to receive drilling fluid from the rig shaker 304 (e.g., after the rig shaker 304 has separated coarser solids from the drilling fluid). In some examples, a drying shaker tank 310 is coupled to and configured to receive drilling fluid from the drying shaker 306 (e.g., after the drying shaker 306 has performed further fluid-solids separation on solids from the rig shaker 304). Accordingly, each of the process pit 308 and the drying shaker tank 310 contains drilling fluid that has at least had certain solids removed therefrom. The open top 302 receives solids from the drying shaker 306 (if present) and the rig shaker 304. The solids in the open top 302 may be waste material that is subsequently discarded or otherwise disposed of.

The container unit 350 is described further below. However, irrespective of whether the container unit 350 is coupled to the mud circulation system 300, in the example of FIG. 3 the mud circulation system 300 may include a first centrifuge 312, a first effluent tank 314, a second centrifuge 316, and a second effluent tank 318. The first centrifuge 312 is coupled to and configured to receive drilling fluid from the process pit 308, while the second centrifuge 316 is coupled to and configured to receive fluid from the drying shaker tank 310. The centrifuges 312, 316 are configured to further remove solids from the drilling fluid (e.g., finer solids than were removed by the rig shaker 304 and the drying shaker 306). The first effluent tank 314 is coupled to and configured to receive centrifuged drilling fluid from the first centrifuge 312, and generally functions as a holding tank for the output of the first centrifuge 312. The second effluent tank 318 is coupled to and configured to receive centrifuged drilling fluid from the second centrifuge 316, and generally functions as a holding tank for the output of the second centrifuge 316. Finally, the mud circulation system 300 includes an active pit 320 that is coupled to and configured to receive drilling fluid from each of the effluent tanks 314, 318. From the active pit 320, drilling fluid is recirculated back downhole through the drillstring 24 and out of the drill bit 32, as described above.

In the example of FIG. 3, the container unit 350 may also implement a standalone sensor package (such as the sensor package 100 shown in FIG. 1, and also in FIG. 2 in further detail) that is configured to be easily coupled to one or more fluid pathways of the mud circulation system 300. The container unit 350 includes schematic representations of first through fourth fluid pathways 352, 354, 356, 358. Each of the fluid pathways 352, 354, 356, 358 schematically represents a fluid conduit and one or more sensors, and may also optionally include supplemental or auxiliary pump(s) and/or other fluid-moving device(s) to induce or assist the flow of fluid from the mud circulation system 300 through the fluid pathways 352, 354, 356, 358 of the container unit 350. However, external pumps may also be used to induce or assist such fluid flow through the container unit 350 as described.

As described, implementing the sensor package in the container unit 350 allows the sensor package to be more easily retrofittable (e.g., plumbed into) the mud circulation system 300. The container unit 350 may be more easily transportable to various rig sites, including both onshore and offshore rig sites. The container unit 350 may include various inlets (e.g., to receive fluid from the mud circulation system 300) and outlets (e.g., to provide fluid back to the mud circulation system 300), and thus is configured to be plumbed into the mud circulation system 300.

Each of the fluid pathways 352, 354, 356, 358 includes an inlet and an outlet, which may be accessible from an exterior surface of the container unit 350. In the example of FIG. 3, the first through third fluid pathways 352, 354, 356 are configured as through pathways, in which the inlet of the fluid pathway 352, 354, 356 is coupled to a first component of the mud circulation system 300 and the outlet of the fluid pathway 352, 354, 356 is coupled to a second component of the mud circulation system 300. In the example of FIG. 3, the fourth fluid pathway 358 is configured as a recirculation pathway, in which the inlet of the fluid pathway 358 is coupled to a same component of the mud circulation system 300 as the outlet of the fluid pathway 358. As described above, the recirculation pathway 358 may include a pump to induce fluid flow through the recirculation pathway 358, where such recirculation of fluid may not have been facilitated without the container unit 350 (i.e., no pump would otherwise be present, and thus no recirculation enabled, without the container unit 350 being present).

In some examples, the container unit 350 may have as few as one fluid pathway (e.g., fluid pathway 352), while in other examples, the container unit 350 may have more than the four fluid pathways 352, 354, 356, 358 depicted in FIG. 3. The container unit 350 may include any combination and number of through pathways and recirculation pathways.

In the specific example of FIG. 3, the first fluid pathway 352 is coupled to the process pit 308 and to the first centrifuge 312. The first fluid pathway 352 is configured to receive drilling fluid from the process pit 308 and to provide drilling fluid to the first centrifuge 312. The first fluid pathway 352 is thus configured to measure one or more properties and/or conditions of the drilling fluid between the process pit 308 and the first centrifuge 312.

Continuing the specific example of FIG. 3, the second fluid pathway 354 is coupled to the drying shaker tank 310 and to the second centrifuge 316. The second fluid pathway 354 is configured to receive drilling fluid from the drying shaker tank 310 and to provide drilling fluid to the second centrifuge 316. The second fluid pathway 354 is thus configured to measure one or more properties and/or conditions of the drilling fluid between the drying shaker tank 310 and the second centrifuge 316.

Still continuing the specific example of FIG. 3, the third fluid pathway 356 is coupled to the first and second effluent tanks 314, 318 and to the active pit 320. The third fluid pathway 356 is configured to receive drilling fluid from the first and second effluent tanks 314, 318 and to provide drilling fluid to the active pit 320. The third fluid pathway 356 is thus configured to measure one or more properties and/or conditions of the drilling fluid between the first and second effluent tanks 314, 318 and the active pit 320.

Continuing further with the specific example of FIG. 3, the fourth fluid pathway 358 is coupled only to the active pit 320, as a recirculation pathway 358. The fourth fluid pathway 358 is configured to recirculate drilling fluid in the active pit 320, and thus to enable relatively continuous (e.g., ongoing) measurement of one or more properties and/or conditions of the drilling fluid in the active pit 320.

As demonstrated in FIG. 3, the sensor package of the container unit 350 may be relatively easily coupled to the mud circulation system 300, such as by plumbing the container unit 350 described herein to the mud circulation system 300. The container unit 350 (and the sensor package thereof) enable sensing or measuring various parameters and/or conditions of the drilling fluid at at least one location in the mud circulation system 300 and, in the specific example of FIG. 3, no fewer than four different locations of the mud circulation system 300.

Figure 4:
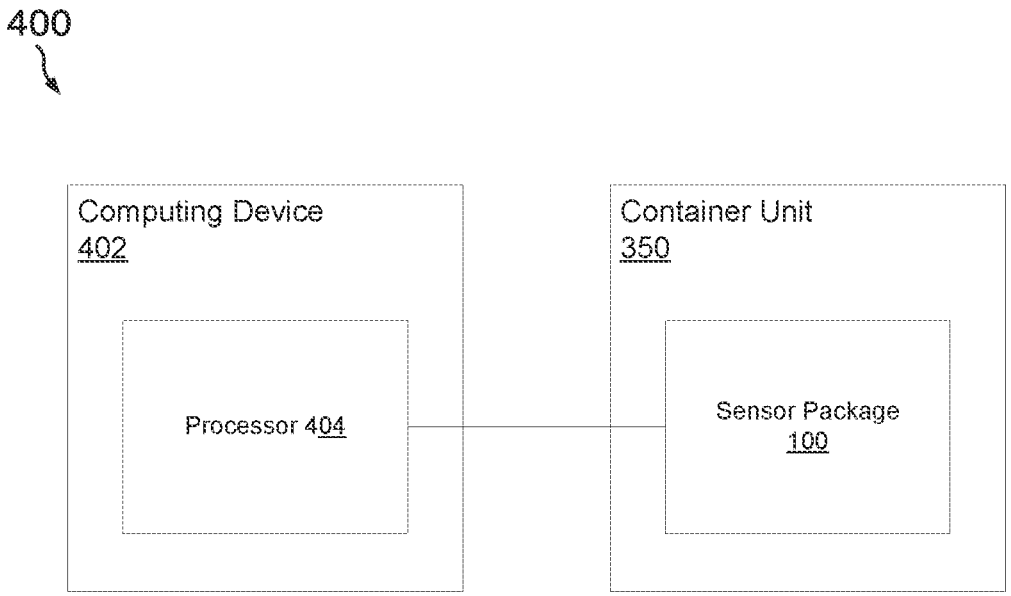
FIG. 4 is a schematic block diagram of a computing device coupled to the container unit of FIG. 3 in accordance with various examples.

FIG. 4 is a schematic block diagram of a system 400 including a computing device 402 coupled to the container unit 350 of FIG. 3 in accordance with various examples. As described above, the computing device 402 may also be coupled to a standalone sensor package 100. The computing device 402 includes a processor 404. The container unit 350 includes a sensor package 100 as described above. For example, the sensor package 100 represents one or more sensor(s) coupled to each of one or more fluid pathways, such as the sensors coupled to the fluid pathways 352, 354, 356, 358 in the specific example of FIG. 3.

The processor 404 may be a general purpose processor, such as a CPU, ASIC, or other combinations of programmable hardware and/or software. In some cases, the processor 404 is configured to execute instructions contained in a non-transitory, computer-readable storage medium (e.g., memory) to perform various functionality described herein. The processor 404 is also configured to be coupled to the sensor(s) in the sensor package 100. For example, the container unit 350 may be configured to be coupled to a network (e.g., a wired network or a wireless network), to which the computing device 402 is also configured to connect. Accordingly, the sensor(s) 100 of the container unit 350 may provide data indicative of sensed parameters to the network, and the computing device 402 (and thus processor 404) is configured to receive such data from the sensors 100.

Based on the data received from the sensor(s) 100, the computing device 402 (and/or the processor 404 thereof) is configured to determine a drilling fluid profile. As described above, drilling fluid may stabilize the borehole wall and counterbalance the internal pressure of formation fluids. Accordingly, the drilling fluid profile may include mud weight and composition information, which are parameters that may be adjusted from time to time during drilling operations to counteract these conditions, and to prevent damage to the borehole wall, loss of well control, and the like.

The processor 404 may be configured to compare the determined drilling fluid profile to a target drilling fluid profile. The target drilling fluid profile may represent a combination of mud properties and/or mud composition information that is appropriate for drilling a particular section of the well, for example. The processor 404 is also configured to determine an adjustment to the drilling fluid profile based on differences between the determined (or measured) drilling fluid profile and the target drilling fluid profile. For example, the adjustment may be to increase a mud weight of the drilling fluid, or to change a mode of operation of one or more of the centrifuges 312, 316.

In some examples, the processor 404 may be configured to generate one or more control signals to automatically adjust the drilling fluid profile based on the comparison between the determined (or measured) drilling fluid profile and the target drilling fluid profile.

As described above, the processor 404 may be configured to receive data from one or more sensors (e.g., including a first sensor and a second sensor), and to determine the drilling fluid profile based on the data from multiple sensors.

In some examples, the processor 404 is configured to determine whether the determined (or measured) drilling fluid profile is within a threshold value of the target drilling fluid profile. For example, the threshold may be plus or minus a certain amount (either absolute or relative) from the specified target drilling fluid profile. Subsequently, the actual drilling fluid profile may be adjusted responsive to the processor 404 determining that the determined drilling fluid profile differs from the target drilling fluid profile by more than the threshold value. On the other hand, the actual drilling fluid profile is not adjusted responsive to the processor 404 determining that the determined drilling fluid profile differs from the target drilling fluid profile by less than the threshold value. The threshold may be established such that remediation of the drilling fluid profile is still achievable even when the threshold is exceeded. That is, the threshold is less than a deviation from the target drilling fluid profile beyond which the drilling fluid could not, as a practical matter, be adjusted back toward the desired or target drilling profile.

Also, in other examples, the processor 404 may be configured to implement a trend-based analysis. For example, a trend may refer to a rate of change over time of one or more sensed or measured parameters (e.g., of the drilling fluid). Based on the determined trend, the actual drilling fluid profile is adjusted responsive to the processor 404 determining that the determined drilling fluid profile differs from the target drilling fluid profile by less than the threshold value and the trend of the drilling fluid profile indicating that the drilling fluid profile is trending away from the target drilling fluid profile. That is, even though the determined drilling fluid profile is within the threshold amount of the target drilling fluid profile, the actual drilling fluid profile is nevertheless adjusted because the trend data indicates that the drilling fluid profile is trending away from the target value (e.g., towards the threshold value).

On the other hand, the actual drilling fluid profile is not adjusted responsive to the processor 404 determining that the determined drilling fluid profile differs from the target drilling fluid profile by less than the threshold value and the trend of the drilling fluid profile indicating that the drilling fluid profile is trending toward the target drilling fluid profile. That is, because the actual drilling fluid profile is trending toward the target drilling fluid profile (e.g., is improving), no adjustments are made to the actual drilling fluid profile.

In some examples, the processor 404 is further configured to transmit an indication of the determined drilling fluid profile to a remote location (e.g., a rig control center) and cause the indication to be displayed at the remote location. The processor 404 may also be configured to cause a recommendation to adjust the drilling fluid profile to be displayed or otherwise presented to a user at the remote location.

In general, the target drilling fluid profile may be determined or otherwise ascertained using various approaches. For example, target drilling fluid profiles may be prescribed or otherwise required by industry standards. Target drilling fluid profiles may also be determined or otherwise calculated based on certain wellbore and/or formation properties, such as to improve integrity of the wellbore and to prevent the inflow of formation fluids. Also, industry best practices and operator know-how may be incorporated to establish the target drilling fluid profile(s) described herein. Regardless of how the target drilling fluid profile is determined, the examples described herein enable a rapid, more ongoing or otherwise continuous comparison between determined or measured drilling fluid profiles and a desired target drilling profile. Subsequently, the drilling fluid profile may be adjusted (e.g., manually by a rig worker or in an automated fashion based on control signals generated by the processor 404) in order to more closely match the target drilling fluid profile.

Figure 5:
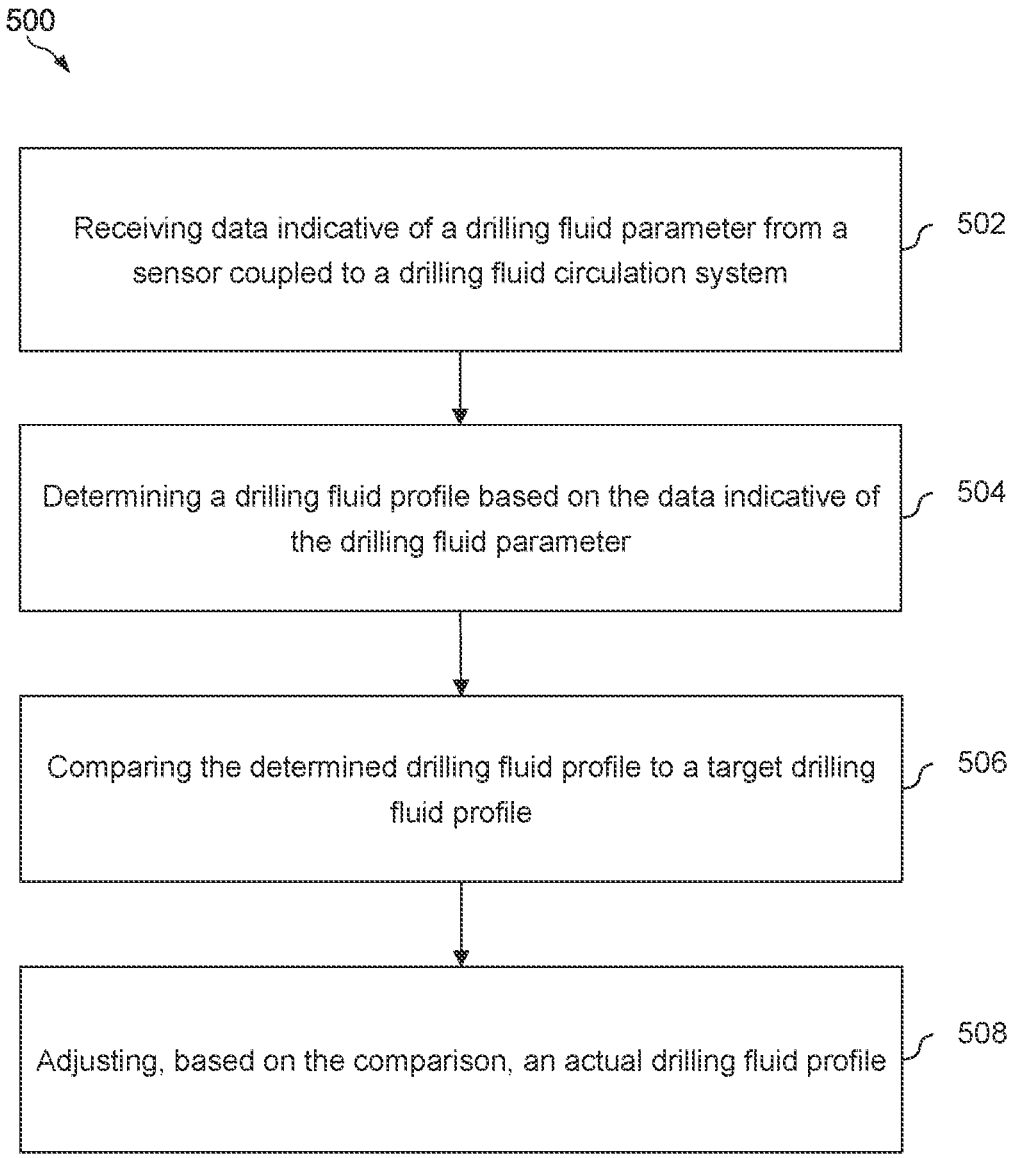
FIG. 5 is a flow chart of a method in accordance with various examples.

FIG. 5 is a flow chart of a method 500 in accordance with various examples. The method 500 begins in block 502 with receiving data indicative of a drilling fluid parameter from a sensor coupled to a drilling fluid circulation system (e.g., mud circulation system 300). For example, the sensor is part of a sensor package (e.g., sensor package 100), which may be embodied in a container unit 350 as described above. The data may be received by a computing device 402 or a processor 404 thereof.

The method 500 continues in block 504 with determining a drilling fluid profile based on the data indicative of the drilling fluid parameter. The method 500 continues further in block 506 with comparing the determined drilling fluid profile to a target drilling fluid profile. Finally, the method 500 concludes in block 508 with adjusting, based on the comparison, an actual drilling fluid profile. In some examples, the method 500 also includes coupling a container unit (e.g., container unit 250) that includes a sensor package (e.g., sensor package 100) to the mud circulation system 200.

Accordingly, the sensor package 100 described herein may be relatively easily coupled to an existing mud circulation system 300, such as by plumbing the container unit 350 described herein to the mud circulation system 300. Subsequently, such as after the container unit 350 has been installed with, or integrated to the mud circulation system 300, the sensor package 100 is configured to sense various drilling fluid parameters, conditions, and the like.

As a result, the examples described herein provide improvements over conventional systems, which have long lag times between tests that impact (i.e., reduce) the accuracy of determining a drilling fluid profile, or parameters. The examples described herein provide further improvements over conventional systems by avoiding retrofitting equipment of the mud circulation system 200 itself to include sensors and/or the ability to measure drilling fluid parameters and/or conditions, which is costly and thus not particularly attractive to manufacturers of such equipment.

While disclosed embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

The term "couple" is used throughout the specification. The term may cover connections, communications, fluid paths, or signal paths that enable a functional relationship consistent with this description. For example, if device A generates a signal to control device B to perform an action, in a first example device A is coupled to device B, or in a second example device A is coupled to device B through intervening component C if intervening component C does not substantially alter the functional relationship between device A and device B such that device B is controlled by device A via the control signal generated by device A.

A device that is "configured to" perform a task or function may be configured (e.g., programmed and/or hardwired) at a time of manufacturing by a manufacturer to perform the function and/or may be configurable (or re-configurable) by a user after manufacturing to perform the function and/or other additional or alternative functions. The configuring may be through firmware and/or software programming of the device, through a construction and/or layout of hardware components and interconnections of the device, or a combination thereof.

Unless otherwise stated, "about," "approximately," or "substantially" preceding a parameter means being within +/−10 percent of that parameter. Modifications are possible in the described examples, and other examples are possible within the scope of the claims.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

What is claimed is:

1. A system, comprising: a container unit, comprising: a first fluid pathway, comprising: a first inlet configured to couple to a first component of a drilling fluid circulation system; and a first outlet configured to couple to a second component of the drilling fluid circulation system; a second fluid pathway, comprising: a second inlet configured to couple to a third component of the drilling fluid circulation system; and a second outlet configured to couple to the third component, wherein within the container unit, the second fluid pathway is fluidically isolated from the first fluid pathway; a first sensor coupled to the first fluid pathway; and a second sensor coupled to the second fluid pathway; and a processor coupled to the first and second sensors, wherein the processor is configured to: receive first data indicative of a first drilling fluid parameter from the first sensor; receive second data indicative of a second drilling fluid parameter from the second sensor; determine a drilling fluid profile based on the first data and the second data; and compare the determined drilling fluid profile to a target drilling fluid profile to determine an adjustment for an actual drilling fluid profile; and adjust a mud weight or a composition of the drilling fluid based on using the determined adjustment.

2. The system of claim 1, wherein when the processor compares the determined drilling fluid profile to the target drilling fluid profile, the processor is further configured to:

determine whether the determined drilling fluid profile is within a threshold value of the target drilling fluid profile;

adjust the actual drilling fluid profile responsive to the determined drilling fluid profile differing from the target drilling fluid profile by more than the threshold value; and not adjust the actual drilling fluid profile responsive to the determined drilling fluid profile differing from the target drilling fluid profile by less than the threshold value.

3. The system of claim 2, wherein the drilling fluid profile comprises data indicative of the drilling fluid parameter as a function of time, and wherein the processor is further configured to:

determine a trend of the drilling fluid profile over time;

adjust the actual drilling fluid profile responsive to the determined drilling fluid profile differing from the target drilling fluid profile by less than the threshold value and the trend of the drilling fluid profile indicating that the drilling fluid profile is trending away from the target drilling fluid profile; and not adjust the actual drilling fluid profile responsive to the determined drilling fluid profile differing from the target drilling fluid profile by less than the threshold value and the trend of the drilling fluid profile indicating that the drilling fluid profile is trending toward the target drilling fluid profile.

4. The system of claim 1, wherein the processor is further configured to transmit an indication of the determined drilling fluid profile to a remote location and cause the indication to be displayed at the remote location.

5. The system of claim 4, wherein the processor is further configured to cause a recommendation to adjust the drilling fluid profile to be presented to a user at the remote location.

6. The system of claim 1, wherein the target drilling fluid profile is generated based on an industry standard, wellbore and formation properties, best practices, or a combination thereof.

7. A method, comprising:

receiving first data indicative of a first drilling fluid parameter from a first sensor coupled to a first fluid pathway of a drilling fluid circulation system, wherein the first fluid pathway is between a first inlet and a first outlet of a container unit;

receiving second data indicative of a second drilling fluid parameter from a second sensor coupled to a second fluid pathway of the drilling fluid circulation system, wherein the second fluid pathway is between a second inlet and a second outlet of the container unit, and wherein the second fluid pathway between the second inlet and the second outlet is fluidically isolated from the first fluid pathway between the first inlet and the first outlet;

determining a drilling fluid profile based on the first data and the second data;

comparing the determined drilling fluid profile to a target drilling fluid profile; and adjusting, based on the comparison, a mud weight or a composition of drilling fluid profile.

8. A method, comprising: receiving first data indicative of a first drilling fluid parameter from a first sensor coupled to a first fluid pathway of a drilling fluid circulation system, wherein the first fluid pathway is between a first inlet and a first outlet of a container unit; receiving second data indicative of a second drilling fluid parameter from a second sensor coupled to a second fluid pathway of the drilling fluid circulation system, wherein the second fluid pathway is between a second inlet and a second outlet of the container unit, and wherein the second fluid pathway between the second inlet and the second outlet is fluidically isolated from the first fluid pathway between the first inlet and the first outlet; determining a drilling fluid profile based on the first data and the second data; comparing the determined drilling fluid profile to a target drilling fluid profile; and adjusting, using the comparison, a mud weight or a composition of drilling fluid.

9. The method of claim 8, wherein comparing the determined drilling fluid profile to the target drilling fluid profile comprises determining whether the determined drilling fluid profile is within a threshold value of the target drilling fluid profile, the method further comprising:

adjusting an actual drilling fluid profile responsive to the determined drilling fluid profile differing from the target drilling fluid profile by more than the threshold value; and not adjusting the actual drilling fluid profile responsive to the determined drilling fluid profile differing from the target drilling fluid profile by less than the threshold value.

10. The method of claim 9, wherein the drilling fluid profile comprises data indicative of the first drilling fluid parameter as a function of time, the method further comprising:

determining a trend of the drilling fluid profile over time;

adjusting the actual drilling fluid profile responsive to the determined drilling fluid profile differing from the target drilling fluid profile by less than the threshold value and the trend of the drilling fluid profile indicating that the drilling fluid profile is trending away from the target drilling fluid profile; and not adjusting the actual drilling fluid profile responsive to the determined drilling fluid profile differing from the target drilling fluid profile by less than the threshold value and the trend of the drilling fluid profile indicating that the drilling fluid profile is trending toward the target drilling fluid profile.

11. The method of claim 8, further comprising transmitting an indication of the determined drilling fluid profile to a remote location and displaying the indication at the remote location.

12. The method of claim 11, further comprising presenting a recommendation to adjust the drilling fluid profile to a user at the remote location.

13. The method of claim 8, further comprising automatically adjusting an actual drilling fluid profile responsive to the comparison.

14. The method of claim 8, wherein the target drilling fluid profile is generated based on an industry standard, wellbore and formation properties, best practices, or a combination thereof.

15. A system, comprising: a first sensor package configured to couple to a drilling fluid circulation system, the first sensor package comprising: a first inlet configured to couple to the drilling fluid circulation system; a first outlet configured to couple to the drilling fluid circulation system, wherein a pathway between the first inlet and the first outlet is a first fluid pathway of a container unit; and a first sensor coupled to the first fluid pathway; a second sensor package configured to couple to the drilling fluid circulation system, the second sensor package comprising: a second inlet configured to couple to the drilling fluid circulation system; a second outlet configured to couple to the drilling fluid circulation system, wherein a pathway between the second inlet and the second outlet is a second fluid pathway of the container unit, and wherein the second fluid pathway between the second inlet and second outlet is fluidically isolated from the first fluid pathway between the first inlet and the first outlet; and a second sensor coupled to the second fluid pathway; and a processor coupled to the first and second sensors, wherein the processor is configured to: receive first data indicative of a first drilling fluid parameter from the first sensor; receive second data indicative of a second drilling fluid parameter from the second sensor; determine a drilling fluid profile based on the first data and the second data; compare the determined drilling fluid profile to a target drilling fluid profile to determine an adjustment for an actual drilling fluid profile; and adjust a mud weight or a composition of the drilling fluid using the determined adjustment.

16. The system of claim 15, wherein when the processor compares the determined drilling fluid profile to the target drilling fluid profile, the processor is further configured to:

determine whether the determined drilling fluid profile is within a threshold value of the target drilling fluid profile;

adjust the actual drilling fluid profile responsive to the determined drilling fluid profile differing from the target drilling fluid profile by more than the threshold value; and not adjust the actual drilling fluid profile responsive to the determined drilling fluid profile differing from the target drilling fluid profile by less than the threshold value.

17. The system of claim 16, wherein the drilling fluid profile comprises data indicative of the drilling fluid parameter as a function of time, and wherein the processor is further configured to:

determine a trend of the drilling fluid profile over time;

adjust the actual drilling fluid profile responsive to the determined drilling fluid profile differing from the target drilling fluid profile by less than the threshold value and the trend of the drilling fluid profile indicating that the drilling fluid profile is trending away from the target drilling fluid profile; and not adjust the actual drilling fluid profile responsive to the determined drilling fluid profile differing from the target drilling fluid profile by less than the threshold value and the trend of the drilling fluid profile indicating that the drilling fluid profile is trending toward the target drilling fluid profile.

18. The system of claim 15, wherein the processor is further configured to transmit an indication of the determined drilling fluid profile to a remote location and cause the indication to be displayed at the remote location.

19. The system of claim 18, wherein the processor is further configured to cause a recommendation to adjust the drilling fluid profile to be presented to a user at the remote location.

20. The system of claim 15, wherein the fluid pathway is a recirculation pathway or a through pathway.

* * * * *